US009846020B2

(12) United States Patent
Mykkänen

(10) Patent No.: US 9,846,020 B2
(45) Date of Patent: Dec. 19, 2017

(54) METHOD AND ARRANGEMENT FOR PROVIDING EXPLOSIVE CHARGING INTO A BORE HOLE

(71) Applicant: Normet Oy, Iisalmi (FI)

(72) Inventor: Anssi Mykkänen, Siilinjärvi (FI)

(73) Assignee: Normet Oy, Iisalmi (FI)

( * ) Notice: Subject to any disclaimer, the term of this patent is extended or adjusted under 35 U.S.C. 154(b) by 0 days.

(21) Appl. No.: 15/303,156

(22) PCT Filed: Apr. 10, 2015

(86) PCT No.: PCT/FI2015/050249

§ 371 (c)(1),
(2) Date: Oct. 10, 2016

(87) PCT Pub. No.: WO2015/155418

PCT Pub. Date: Oct. 15, 2015

(65) Prior Publication Data

US 2017/0030694 A1 Feb. 2, 2017

(30) Foreign Application Priority Data

Apr. 10, 2014 (FI) ..... 20145341

(51) Int. Cl.
*F42B 3/00* (2006.01)
*F42D 1/10* (2006.01)
*F42D 1/18* (2006.01)

(52) U.S. Cl.
CPC ..... *F42D 1/10* (2013.01); *F42D 1/18* (2013.01)

(58) Field of Classification Search
USPC ..... 102/313; 166/259; 175/2, 1
See application file for complete search history.

(56) References Cited

U.S. PATENT DOCUMENTS 3,804,182 A * 4/1974 Adair ..... E21B 7/007 175/1
3,856,095 A * 12/1974 Adair ..... E21B 7/007 175/1

(Continued)

FOREIGN PATENT DOCUMENTS

CA 2236002 A1 5/1997
CA 2825166 10/2013

(Continued)

OTHER PUBLICATIONS

Finnish Patent and Registration Office, search report dated Feb. 12, 2014 (FI patent application No. 20145341).

*Primary Examiner* — J. Woodrow Eldred
(74) *Attorney, Agent, or Firm* — Berggren, Inc.

(57) ABSTRACT

An arrangement for providing explosive charging and a plug into a bore hole, wherein a hose comprising at least one first conduit is introduced into said bore hole. Also explosive material is introduced to an outlet of said first conduit and thereby into said bore hole. In addition a plug is introduced into said bore hole by the help of said hose. The plug has a diameter, the size of which is configured to be manipulated after or during introducing into said bore hole at a certain depth so that after said introducing the diameter of the plug is larger than before said introducing and so that the surface of the plug after manipulating the size of diameter essentially make a physical contact with the bore hole surface. The plug is introduced by said hose in a releasable manner so that after or during the manipulation of the plug diameter size the plug is configured to be released from the hose and to stay in said bore hole essentially at said certain depth.

22 Claims, 2 Drawing Sheets

(56) References Cited

U.S. PATENT DOCUMENTS

| | | | | |
|---|---|---|---|---|
| 3,943,820 | A | 3/1976 | Persson | |
| 4,057,780 | A * | 11/1977 | Shuck | E21B 43/263 166/305.1 |
| 5,000,261 | A | 3/1991 | Fitzgibbon | |
| 5,524,523 | A | 6/1996 | Luebbe | |
| 2016/0033249 | A1 * | 2/2016 | Alexander | F42D 3/00 405/268 |
| 2016/0145165 | A1 * | 5/2016 | Zank | C06B 21/0008 102/313 |

FOREIGN PATENT DOCUMENTS

| | | | |
|---|---|---|---|
| JP | 2000283700 | A | 10/2000 |
| WO | WO2004048749 | A1 | 6/2004 |
| WO | WO2008144846 | A1 | 12/2008 |

* cited by examiner

METHOD AND ARRANGEMENT FOR PROVIDING EXPLOSIVE CHARGING INTO A BORE HOLE

PRIORITY

This application is a U.S national application of PCT-application PCT/FI2015/050249 filed on Apr. 10, 2015 and claiming priority of Finnish national application number FI 20145341 filed on Apr. 10, 2014, the contents of both of which are incorporated herein by reference.

TECHNICAL FIELD OF THE INVENTION

The invention relates to a method and arrangement for providing explosive charging into a mining or tunnelling hole, or a bore hole hereinafter.

BACKGROUND OF THE INVENTION

One of the typical explosive charging material especially for bore holes is ANFO (ammonium nitrate-fuel oil explosive), the base material of which is like a dry powder. The explosive end product can be achieved by mixing the dry powder ammonium nitrate with additive material, such as water, fuel oil or special chemicals (later additives). The mixing additionally makes ANFO sticky so to stay better in vertical up holes. Another purpose of increasing the additive is reducing dusting of dry ANFO. Usually this additive is dosed directly to an ANFO tank or right after the tank if special dosing devices are used. However, this method usually results blockages in the ANFO tank and ANFO hoses because of softened half-melted ANFO prill structure. Blockages slow down charging work and due that whole mining cycle.

Also other types of explosive charging materials are used, such as in site sensitized emulsion charging emulsion matrix, which is not explosive material as such, but it is sensitized to emulsion explosive by using dedicated gassing solution which is mixed to matrix. Typically the gassing solution is dosed and mixed in an early stage in process unit and then pumped through water lubricated 20-60 m long charging hose, for example, to the bore hole.

However when gassing solution is mixed in an early stage of emulsion line it means that gassing reaction starts to happen immediately. If for example there 15-30 min shutdown happens during the charging, the emulsion matrix in charging hoses starts to be fully sensitized to emulsion explosive. This creates great danger because detonator and primer are pushed to bore hole by same charging hose which is full of explosive material.

In addition problems relate also to ensuring that the materials used for explosive charging would be introduced in a desired depth in the hole and so that they would not flow to an undesired portion of the hole. The hole may be e.g. an upper hand hole, where the hole is drilled in upward direction, whereupon it must be ensured that the charging materials do not flow away from the hole. Other example is the case of a lower hand hole, where the hole is charged from above and where the charging materials should not enter into the bottom of the hole, or where there is a need to leave an empty portion into the hole and thus ensure that the charging material does not flow into the bottom or into the empty portion of the hole.

Previously mechanical blockages are inserted into the hole before introducing the charging materials. The mechanical blockages, such as fabric bundles are e.g. pushed by long sticks into the hole before charging the hole. This is very cumbersome and slow technique, because at first the mechanical blockage must be inserted into the hole. In addition it is difficult to push by a long stick a mechanical blockage into the hole at a certain depth, because the mechanical blockage tangles easily in the surface of the hole already before suitable location. Especially this is hard with the upper handed holes, where the mechanical blockage must be pushed in upward direction. Furthermore the pushing stick might get broken, whereupon it may be even impossible to get the broken part of the stick away from the hole. Especially all of these steps are time consuming.

SUMMARY OF THE INVENTION

An object of the invention is to alleviate and eliminate the problems relating to the known prior art. Especially the object of the invention is to provide an arrangement and method, as well as a charging hose for ensuring that the materials used for explosive charging would be introduced and keep in a desired depth in the hole and so that they would not flow to an undesired portion of the hole. In addition the object is to perform the task easily and fast as well as in a reliable manner. An additional object of the invention is for enabling to provide explosive charging into a bore hole so that the blockages of the explosive material in the hose or danger of explosion caused by the sensitized emulsion explosive can be overcome and avoided.

The object of the invention can be achieved by the features of independent claims.

The invention relates to an arrangement providing explosive charging and a plug into a bore hole according to claim 1. In addition the invention relates to a charging hose according to claim 20 and a method providing explosive charging into a bore hole according to claim 21.

According to an embodiment of the invention the arrangement and charging hose for providing explosive charging and a plug into a bore hole, such as mining or tunnelling hole, comprises at least one first conduit advantageously arranged into the hose. According to an example the conduit as such is form by said hose. The conduit is configured to be introduced into the bore hole. In addition is it used for introducing at least one component of an explosive material to an outlet of said first conduit and thereby into said bore hole.

In addition the arrangement comprises also at least one plug, which is configured to be introduced into said bore hole by the help of said hose. The plug has a diameter, the size of which is configured to be manipulated after or during introducing into said bore hole at a certain depth so that after said introducing the diameter of the plug is larger than before said introducing and so that the surface of the plug after manipulation essentially make a physical contact with the bore hole surface. Moreover the plug is advantageously introduced into the hole in a releasable manner so that after or during the manipulation of the plug diameter size the plug is be released from the hose so that it stays in the bore hole essentially at said certain depth. The plug either expands so that it sticks into the hole, and/or it has material with friction coefficient so that it will be stick especially after size manipulation into the hole surface.

The plug advantageously comprises a (closed) volume, which can be manipulated so that the outer volume and thereby said plug diameter size increases. Therefore the plug makes a physical contact with the bore hole surface and form a mechanical blockage into the hole. The plug comprises according to an example inner and outer volumes, whereupon the diameter or outer volume of the plug can be manipulated for example by feeding a filling agent into the inner volume of the plug. The filling agent, such as pressurized air, is advantageously fed into the plug via at least one conduit of the hose. The medium filled plug advantageously stays filled without any enormous leakage after releasing.

The plug is according to an example coupled with the hose by a breakaway type quick release coupling, such as a bayonet coupling, but also other types of coupling means can be used, such as a tie around the plug, where the tie is configured to be broken when the plug is filled. The coupling is advantageously configured to release the plug from the hose, when the physical contact is made between the plug and the bore hole surface, and/or when the hose is pulled away from the bore hole.

According to an embodiment the plug may comprise compressible material or structure. As an example the plug may be a shuttlecock type bore hole plug or the like, whereupon the plug may be compressed by applying an external force before and during the introduction the plug into the bore hole. Thus, when the external force is removed after or during introducing the plug into said bore hole at the certain depth, the plug expands and sticks into the surface of the bore hole and form the blockage.

As an example the external force may be applied by introducing the plug into the bore hole inside a tube, sock, sleeve or the like, where the tube or the like compresses the plug during introduction. The plug can be removed or released from the tube e.g. by pushing it by a medium, advantageously e.g. by pressurized air, which is fed via at least one conduit. When the compressed plug is removed from the compression tube, the expansion of the plug diameter size is then allowed so that the plug expands and thereby sticks into the surface of the bore hole at the desired depth.

According to an advantageous embodiment the plug is a shuttlecock type plug or functionally similar plug. In addition the tube used for introducing said plug is advantageously a portion of at least one conduit. As an example the shuttlecock can be inserted at the opening of conduit or hose, whereupon it can be "shot" by pressurised air pulse fed via said conduit or hose, when the end of the hose is at the desired depth and before feeding the explosive material via said hose or conduit.

Still, according to an embodiment the plug may be provided by introducing at least one, preferably two or more chemical components so that it or they will expand after or during releasing from the hose or outlet of the conduit(s). The chemicals may be for example polyol component and polymeric component, when a hydrophobic polyurethane foam is formed when mixed. This kind of foam is tough, rigid and resistant, as well as its expansion can be controlled, whereupon it is suitable as a plug. When the mixing is performed at the outlet of the hose/conduit(s), a suitable plug, which stays in the bore hole essentially at said certain depth can be formed.

It is to be noted that according to an advantageous embodiment the plug can be introduced into the bore hole essentially by the same one in-out movement of the hose than used for introducing at least the component(s) of an explosive material. Advantageously the plug is provided (brought, released and/or formed) into or at the desired depth in the bore hole, whereupon the charging material(s) can be fed directly after the plug is inserted or formed into the hole. This offers huge advantages over the known prior art solutions, namely the whole plugging and charging can be done by one movement, which saves time. In addition is it very easy way to introduce said plug, because there is no need for separate instruments for pushing any initially large mechanical blockages into the hole, which can jam into the hole already before the desired depth, or even worse if they are pushed too far, it is practically impossible to pull them back into the desired depth.

According to an example the arrangement and charging hose comprises a charging conduit and an additional conduit both comprising inlets and outlets, respectively. The charging conduit is configured for introducing explosive base material, such as e.g. ANFO or emulsion based material to the outlet of said charging conduit. The additional conduit is configured for introducing additive material, such as e.g. water, fuel oil or special chemicals to the outlet of said additional conduit. The additive materials are used e.g. to make ANFO sticky so to stay in vertical up holes, as well as reducing dusting of dry ANFO. The additives can also be used for gassing solution used for sensitizing an emulsion explosive, for example.

According to an advantageous embodiment said charging conduit and additional conduit are arranged into a common hose, which can then be introduced into said bore hole so that said explosive base material and additive material are provided via said own conduits separately from each other and without any contact with each other. The explosive base material and additive material are configured to be mixed in the arrangement with each other after said outlets of said conduits in order to provide said explosive charging into the bore hole. According to an embodiment said common hose forms said charging hose.

Thus the additive can be brought separately to the outlet of the charging conduit and dose it directly. The mixing of the additive into the ANFO flow can thus be done using at the end portion (outlet) of the charging conduit by using a suitable ejector and nozzle, for example. This embodiment significantly decreases the blockages and due that down times in charging and whole mining cycle.

Relating to emulsion the sensitization of emulsion explosive can be avoided with separate additional channel and by injecting gassing solution at the late stage of process just the end portion (outlet) of the charging conduit. According to an embodiment mixer device may be arranged after gassing solution junction to properly mix the gassing solution to the base matrix.

The mixing of the explosive base material and additive material is advantageously arranged before the outlet of the common hose, like e.g. 1 or few meters before the outlet of the common hose so to ensure a better mixing during the end portion of the common hose.

According to an embodiment the arrangement and the charging hose comprises additionally a third conduit for further additional media, such as for pressurized air, for example. The third and additional conduits are advantageously arranged symmetrically into the opposite sides of the common hose in order to make the common hose more durable and stable, even if this is not compulsory. According to an embodiment the third and additional conduits are arranged at the rim portion of the common hose and the centre portion of the common hose is used as a charging conduit. The outlets at least of the charging and additional conduits are arranged before the outlet of the common hose. Also the outlet (e.g. sub-outlet) of the third conduit can be arranged before the outlet of the common hose, but according to an embodiment it can also be arranged at the outlet area of the common hose.

According to an embodiment the common hose (or charging hose) is configured to introduce a bore hole plugging into the bore hole. Very often downward bore holes through to a next level must be plugged before charging. Also in upward emulsion charging hole must be plugged right after charging. Otherwise charged emulsion can come down initially after charging. According to an embodiment the integrated additional or third conduits of the common hose (or charging hose) are configured to be used as a channel for introducing filling agent or other manipulating agent to dedicated bore hole plug devices, like blast air balls, so that they are able to plug the bore holes.

According to an advantageous embodiment the arrangement may be automatized at least partially. The hose with the plug can be introduced into the bore hole, after which the plug is released at the first predetermined depth, after which the explosive material is provided starting at the second predetermined depth. It is to be noted that the plug may be released before feeding the explosive material and/or vice versa. In addition the first plug may be released first, after which the first portion of the explosive material can be fed, next the second plug may be released at the second depth and so on. Thus, according to the invention it is possible to automatically provide the explosive material, as well as the plug(s), in suitable locations into the bore hole.

In addition according to an embodiment the concentration of the mixed explosive provided into the bore hole can be changed in the function of the depth so that in the first portion of the hole the provided mixed explosive has a first concentration and in the second portion of the hole the provided mixed explosive has a second concentration differing from the first one.

The present invention offers advantagese over the known prior art, such as by the invention great number of possible blockages can be avoided, since the ANFO is not mixed with additive until the end portion of the charging hose. In addition gassing reaction starts only at the end portion of the charging hose, which removes the danger of explosion caused by the sensitized emulsion explosive in the charging hose. In addition the common hose comprising the conduits, both the charging conduit and the additional conduit, and optionally also the third conduit, can be used with one hose manipulator and/or one hose feeder, for example, whereupon the operation of the whole charging project is very easy and fast, as well as additionally also safe maneuver.

BRIEF DESCRIPTION OF THE DRAWINGS

Next the invention will be described in greater detail with reference to exemplary embodiments in accordance with the accompanying drawings, in which.

DETAILED DESCRIPTION

Figure 1:
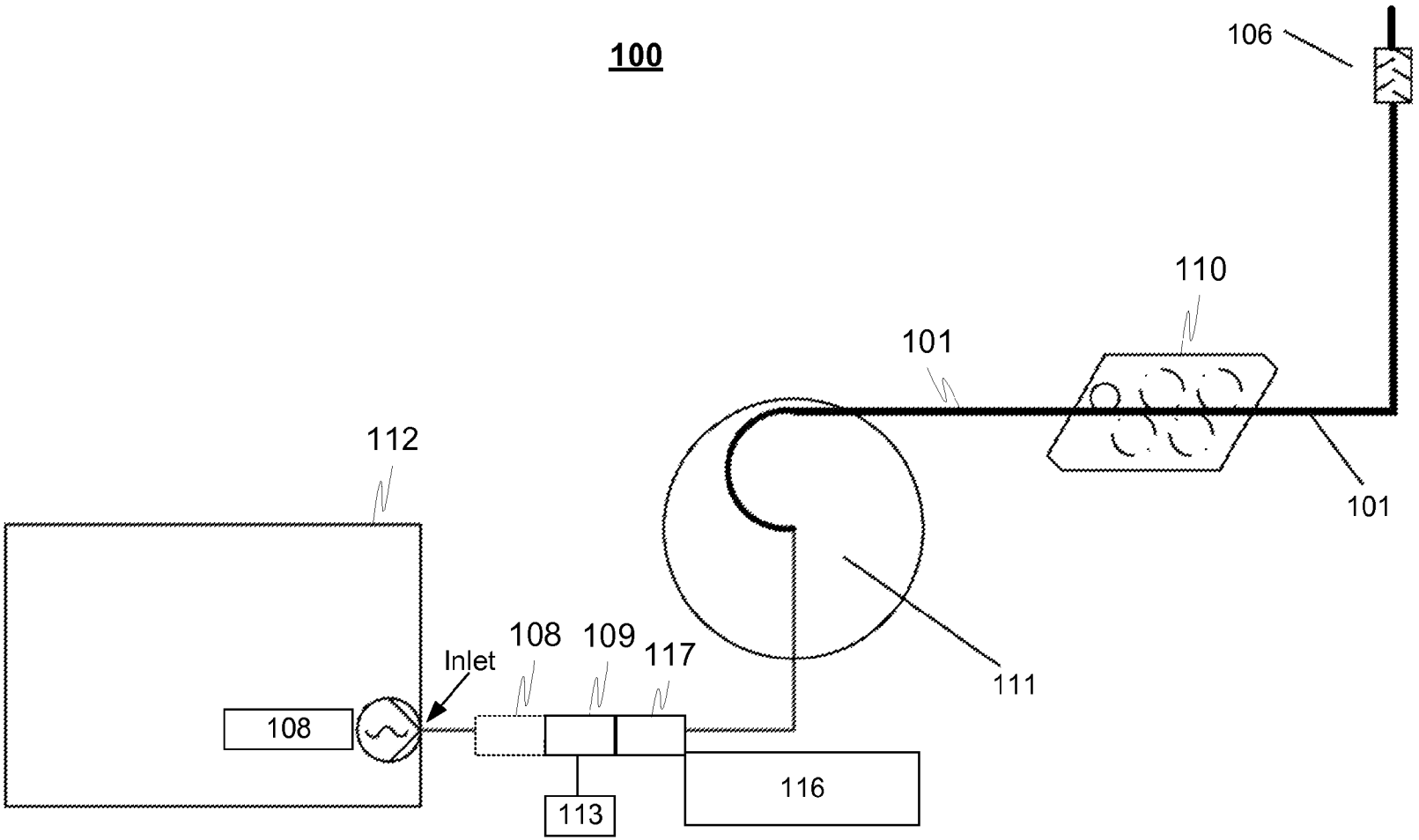
FIG. 1 illustrates a principle of an exemplary arrangement for providing explosive charging into a bore hole according to an advantageous embodiment of the invention.

FIG. 1 illustrates a principle of an exemplary arrangement 100 and FIGS. 2A-2B and FIGS. 3A-3B examples of a charging hose 101 for providing explosive charging and a plug 114 into a bore hole 102 according to an advantageous embodiment of the invention. The arrangement 100 and charging hose 101 comprises at least one first conduit 103 advantageously arranged into the hose 101, as well as at least one plug 114, which is be introduced into the bore hole 102 by the help of said hose.

Figure 3A:
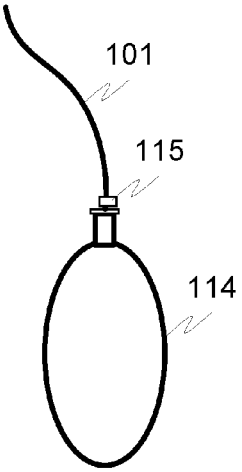
FIGS. 3A-3B illustrates a principle of an exemplary bore hole plug and arrangement for providing a bore hole plug into a bore hole according to an advantageous embodiment of the invention.
Figure 3B:
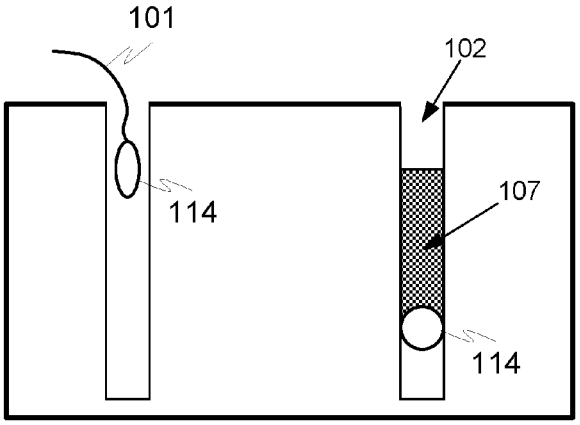

As can be seen especially in FIG. 3B the plug 114 has a diameter, the size of which is configured to be manipulated after or during introducing the plug into the bore hole 102 at a certain depth so that after said introducing the diameter of the plug is larger than before said introducing and so that the surface of the plug after manipulation essentially make a physical contact with the bore hole surface. Moreover the plug is advantageously introduced into the hole in a releasable manner, which can be implemented e.g. by coupling the plug, such as a ball, with the hose 101 by a breakaway type quick release coupling 115, such as a bayonet coupling.

The arrangement 100 and charging hose 101 comprises also according to an embodiment a charging conduit 103 and an additional conduit 104 both comprising inlets and outlets, respectively. The charging conduit 103 is configured for introducing explosive base material to the outlet of said charging conduit. The additional conduit 104 is configured for introducing additive material.

Figure 2A:
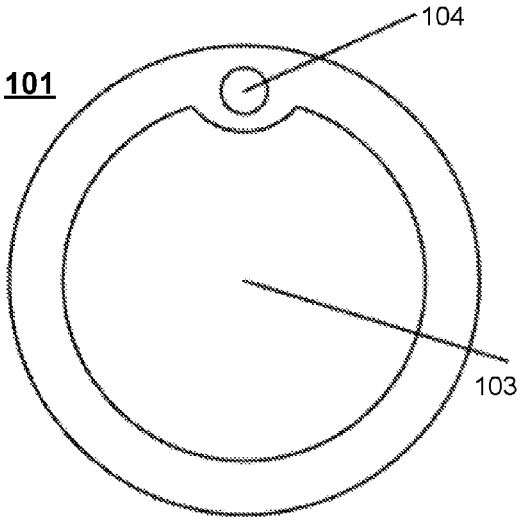
FIGS. 2A-2B illustrate examples of a charging hose for providing explosive charging into a bore hole according to an advantageous embodiment of the invention.
Figure 2B:
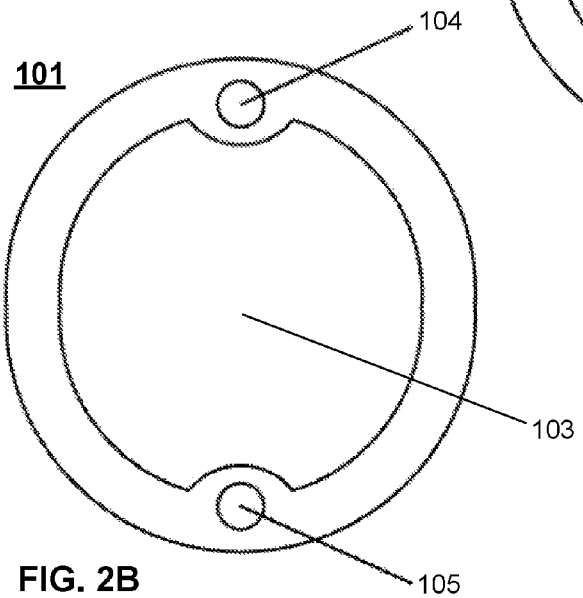

As can be seen in particularly in FIGS. 2A and 2B the charging conduit 103 and additional conduit 104 are advantageously arranged into a common hose 101 (charging hose). The charging hose 101 can then be introduced into the bore hole 102 so that the explosive base material and additive material are provided via said own conduits 103, 104 separately from each other and without any contact with each other. The explosive base material and additive material are mixed by a mixer device 106 with each other after said outlets of said conduits 103, 104 in order to provide said explosive charging 107 into the bore hole.

As is illustrated in FIG. 2B the charging hose 101 may also comprise additionally a third conduit 105 for further additional media, such as for pressurized air, for example. The third 105 and additional conduits 104 are advantageously arranged symmetrically into the opposite sides of the common hose 101. The third 105 and additional conduits 104 are arranged at the rim portion of the common hose 101 and the centre portion of the common hose is used as a charging conduit 104.

The outlets at least of the charging 103 and additional conduits 104 are advantageously arranged before the outlet 101*a* of the common hose 101. Also the outlet of the third conduit 105 can be arranged before the outlet 101*a* of the common hose, but according to an embodiment it can also be arranged at the outlet area 101*a* of the common hose 101. According to an embodiment, when the outlet portions of the conduits are arranged before the outlet 101*a* of the common hose 101*a*, the end portion (portion after the outlets of the conduits 103, 104 and possibly 105) of the common hose 101 forms only one hose structure, where the explosive base material and additive material transferred in the mixed form.

According to an embodiment the arrangement comprises a mixer 106 arranged in connection with the hose. The mixer 106 is advantageously 103, 104, especially when the mixer 106 is used to mix the explosive base material and additive material, like ANFO and water, fuel oil or special chemicals. According to another embodiment the mixer 106 mat located at the end (outlet 101*a*) of the common hose, especially where the mixer (or a suitable ejector and nozzle) is used for gassing emulsion.

According to an embodiment the arrangement may also comprise a feeding means (or feeder or pump) 108 for feeding said explosive base material and a dosing means (or dispenser) 109 configured for dosing said additive material in a certain relation with the fed explosive base material. It is to be noted that these means 108, 109 may also locate elsewhere in the arrangement than described in Figures, as for example in a tank 112. The arrangement may also comprise a hose pusher 110 for pushing the hose with the plug into the mining hole 102 in a controllable manner, so for example into a desired depth before releasing the plug. The hose pusher 110, as well as valves and feeding means or pumps are advantageously coupled with a control unit 116, which is configured to control the feeding of the charging material(s), feeding of the hose as well as manipulation and releasing of the plug.

In addition the arrangement may also comprise a reel 111 for carrying the hose, where the inlet of the charging conduit is configured to be introduced into a tank 112 of explosive base material and the inlet of the additional conduit is configured to be introduced into a tank 113 of additive material. The inlet of the optional third conduit 105 is configured to be introduced into an air compressor, for example (not shown).

FIG. 3 illustrates a principle of an exemplary arrangement 100 for providing a bore hole plug 114 into the bore hole 102 according to an advantageous embodiment of the invention. According to an embodiment the common hose 101 (or charging hose) is configured to introduce the bore hole plugging 114 into the bore hole so that the integrated additional 104 or third conduits 105 of the common hose 101 (or charging hose) are configured to be used as a channel for introducing filling agent or other manipulating agent to dedicated bore hole plug devices 114. The bore hole plug may be e.g. a blast air ball 114, which is configured to expand for example and thereby to plug the bore hole 102. Also other kinds of plugs components and otherwise suitable for using as the plug in the meaning described here are possible.

The hose 101 is advantageously configured to bring also the bore hole plug 114 with itself to the mining hole 102. The outer volume of the bore hole plug is advantageously configured to be manipulated by feeding filling agent, like air or water or the like into the bore hole plug. The arrangement advantageously comprises a remote controllable valve 117 coupled between the additional or third conduit 104, 105 (or the hose may comprise a second additional conduit for filling agent of filling said plug) and the bore hole plug 114 located advantageously at the end portion of the hose 101.

In the rest state the outer volume of the bore hole plug 114 is small, as can be seen ion FIG. 3A, whereupon it can be fed into the bore hole 102. When the bore hole plug is inserted into the hole 102 at the suitable level, the bore hole plug 114 may be manipulated so to change its outer volume e.g. by controlling the flow of said additional or third conduit 104, 105 for said bore hole plug via the remote controllable valve 117, as can be seen in FIG. 3B. The change of the outer volume of said bore hole plug 114 may be configured to be happened e.g. by feeding filling agent into said bore hole plug.

The invention has been explained above with reference to the aforementioned embodiments, and several advantages of the invention have been demonstrated. It is clear that the invention is not only restricted to these embodiments, but comprises all possible embodiments within the spirit and scope of the inventive thought and the following patent claims. For example even if the anfo or charging emulsion matrix are mentioned as the explosive base material, it is to be noted that also other suitable explosive material can also be used. The same applies also to additives and possible filling agent, they can also be selected other ways suitable for the application in question. In addition it is to be noted that also more than one plug can be introduced into the hole by same movement of the hose. For example the first plug may be coupled with the first conduit, and the second plug with the second conduit and advantageously so that they can be manipulated and released independently of each other.

The invention claimed is:

1. An arrangement for providing explosive charging and a plug into a bore hole comprising a surrounding bore hole surface, wherein the arrangement comprises:

a hose comprising at least one first conduit to be introduced into said bore hole and for introducing at least one component of an explosive material to an outlet of said at least one first conduit and further to an outlet of the hose, and thereby into said bore hole, and at least one plug configured to be introduced into said bore hole by said hose, wherein said at least one plug has a surface and a diameter, the diameter being configured to be changeable when the at least one plug is introduced into said bore hole at a certain depth so that at the certain depth the diameter of the at least one plug is larger than before said introducing and so that the surface of the at least one plug after changing the size of the diameter essentially makes a physical contact with the bore hole surface, said at least one plug is configured to be introduced by said hose in a releasable manner so that the at least one plug is configured to be released from the hose and to stay in said bore hole at said certain depth when the diameter size of the at least one plug is changed, and wherein said at least one plug is configured to be introduced into said bore hole by one in-out movement cycle of the hose, which movement cycle is also used for introducing said at least one component of an explosive material, and wherein said one movement cycle comprises pushing the hose into said bore hole and pulling the hose out from said bore hole.

2. An arrangement of claim 1, wherein the arrangement comprises a second conduit for introducing additive material to an outlet of said second conduit and further to the outlet of the hose, and wherein the at least one first conduit is a charging conduit, wherein said charging conduit and said second conduit are arranged into the hose being a common hose configured to be introduced in said bore hole so that the at least one component of an explosive material and said additive material are provided via said conduits separately from each other, and wherein said at least one component of an explosive material and the additive material are configured to be mixed with each other after outlets of said conduits in order to provide said explosive charging into the bore hole.

3. An arrangement of claim 1, wherein said at least one plug comprises a volume, which is configured to be changeable so that upon increase of the volume said diameter size of the at least one plug increases and surface of the at least one plug makes a physical contact with the bore hole surface.

4. An arrangement of claim 2, wherein said at least one plug comprises an inner and an outer volume, and said diameter or outer volume of the at least one plug is configured to be changeable by feeding a filling agent into the inner volume of the at least one plug, wherein said filling agent is advantageously provided into the at least one plug via said first or second conduit of the hose.

5. An arrangement of claim 2, wherein the arrangement comprises a controllable valve coupled with said first or second conduit of the hose and with said at least one plug, and the arrangement is configured to provide filing agent into the at least one plug to change its volume or outer diameter by controlling the flow of said first or second conduit into said at least one plug.

6. An arrangement of claim 1, wherein said at least one plug is coupled with said hose by a breakaway type quick release coupling, which is configured to release the at least one plug from the hose, when a physical contact is made between the surface of the at least one plug and the bore hole surface, or when the hose is pulled away from the bore hole.

7. An arrangement of claim 1, wherein said at least one plug is configured to be compressed by applying an external force so that an outer volume and thereby the size of the diameter of the at least one plug is smaller than before applying an external force and before introduction into the bore hole, and whereupon the external force is configured to be removed after introducing the at least one plug into said bore hole at the certain depth.

8. An arrangement of claim 7, wherein the external force is applied by introducing said at least one plug into the bore hole inside a tube, said tube compressing said at least one plug during introduction, and where said at least one plug is configured to be released from the tube by pushing it by a medium fed via said first or second conduit and thereby allowing the expansion of the diameter size of the at least one plug after releasing from the tube.

9. An arrangement of claim 7, wherein the at least one plug has a shape of a shuttlecock.

10. An arrangement of claim 1, wherein the arrangement is configured to provide said at least one plug by providing at least one, chemical component so that the at least one chemical component will expand after or during releasing from the hose and thereby making the at least one plug to stay in said bore hole essentially at said certain depth.

11. An arrangement of claim 2, wherein the outlets of the first and second conduits are arranged in the hose so that the at least one component of an explosive material and the additive material are mixed before releasing from the hose.

12. An arrangement of claim 1, wherein the arrangement further comprises a feeding device for feeding said at least one component of an explosive material and a dosing device configured for measuring a dose of said additive material in a certain relation with the at least one component explosive material fed.

13. An arrangement of claim 1, wherein the arrangement comprises a mixer arranged to the outlet of the hose, where said mixer is configured to mix said at least one component of an explosive material and the additive material.

14. An arrangement of claim 13, wherein the mixer comprises an ejector and a nozzle, which are configured to make said mixing and outputting the mixing from the hose to the bore hole.

15. An arrangement of claim 2, wherein the arrangement comprises a reel for carrying said hose, where an inlet of the at least one first conduit is configured to be introduced into a tank of explosive base material and an inlet of the second conduit is configured to be introduced into a tank of the additive material.

16. An arrangement of claim 4, wherein said at least one component of an explosive material is a charging emulsion matrix, and wherein said additive material is chosen from the group consisting of water, and fuel oil, and wherein said filling agent is chosen from the group consisting of air and water.

17. An arrangement of claim 1, wherein the arrangement is configured to introduce the hose with the at least one plug into the bore hole, release the at least one plug at a first predetermined depth and provide the explosive material starting at a second predetermined depth.

18. Arrangement of claim 2, wherein the arrangement is configured to change concentration of mixed explosive material provided into the bore hole so that in a first portion of the hole the provided mixed explosive material has a first concentration and in a second portion of the hole the provided mixed explosive material has a second concentration differing from the first one.

19. A charging hose for providing explosive charging and a plug into a bore hole comprising a surrounding bore hole surface, wherein:

the charging hose comprises at least one first conduit to be introduced into said bore hole and for introducing at least one component of an explosive material to an outlet of said at least one first conduit and thereby into said bore hole, the charging hose is configured to introduce at least one plug into said bore hole, wherein said at least one plug has a surface and a diameter, the the diameter being configured to be changeable when the at least one plug is introduced into said bore hole at a certain depth so that after said introducing the diameter of the at least one plug is larger than before said introducing and so that the surface of the at least one plug after changing the size of diameter makes a physical contact with the bore hole surface, said at least one plug is configured to be introduced by said hose in a releasable manner so that the at least one plug is configured to be released from the hose and to stay in said bore hole essentially at said certain depth when the diameter size of the at least one plug is changed, and wherein said plug is configured to be introduced into said bore hole by one in-out movement cycle of the hose which movement cycle is also used for introducing said at least said one component of an explosive material, and wherein said one movement cycle comprises pushing the hose into said hole and pulling the hose out form said bore hole.

20. A method for providing explosive charging and a plug into a bore hole comprising a surrounding bore hole surface, wherein the method comprises steps of:

introducing a hose comprising at least one first conduit into said bore hole and introducing at least one component of an explosive material to an outlet of said at least one first conduit and thereby into said bore hole, introducing at least one plug having a diameter and a surface into said bore hole by said hose, changing said size of the diameter of the at least one plug when the at least one plug is introduced into said bore hole at a certain depth so that the diameter of the at least one plug is larger than before said introducing and so that the surface of the at least one plug after changing the size of diameter makes a physical contact with the bore hole surface, introducing said at least one plug by said hose in a releasable manner so that after or during the manipulation of the size of the diameter of the at least one plug the at least one plug is released from the hose to stay in said bore hole essentially at said certain depth, and introducing said at least one plug into said bore hole by one in-out movement cycle of the hose, which movement cycle is also used for introducing said at least said one component of an explosive material, and wherein said one movement cycle comprises pushing the hose into said hole and pulling the hole out from said hole.

21. An arrangement of claim 6, wherein said breakaway type quick release coupling is a bayonet coupling.

22. An arrangement of claim 2, wherein the arrangement comprises a nozzle, and wherein the nozzle comprises a mixer, which is configured to mix said at least one component of the explosive material and additive material.

* * * * *